US006672398B2

(12) United States Patent
Theurer et al.

(10) Patent No.: US 6,672,398 B2
(45) Date of Patent: Jan. 6, 2004

(54) BALLAST CLEANING MACHINE

(75) Inventors: Josef Theurer, Vienna (AT); Herbert Wörgötter, Gallneukirchen (AT)

(73) Assignee: Franz Plasser Bahnbaumaschinen-Industriegesellschaft m.b.H., Vienna (AU)

( * ) Notice: Subject to any disclaimer, the term of this patent is extended or adjusted under 35 U.S.C. 154(b) by 0 days.

(21) Appl. No.: 10/108,291

(22) Filed: Mar. 27, 2002

(65) Prior Publication Data

US 2002/0157840 A1 Oct. 31, 2002

(30) Foreign Application Priority Data

Apr. 26, 2001 (AT) ..... 330/2001 U

(51) Int. Cl.[7] ..... E21B 27/00
(52) U.S. Cl. ..... 171/16; 104/7.1; 37/104
(58) Field of Search ..... 37/104, 105, 106, 37/107; 171/16; 104/2, 5, 7.1, 7.3, 12; 105/454

(56) References Cited

U.S. PATENT DOCUMENTS

| | | | | |
|---|---|---|---|---|
| 4,614,238 A | | 9/1986 | Theurer et al. | |
| 4,630,541 A | * | 12/1986 | Theurer et al. | 104/7.2 |
| 5,090,483 A | * | 2/1992 | Theurer et al. | 171/16 |
| 5,090,484 A | * | 2/1992 | Theurer et al. | 171/16 |
| 5,257,580 A | * | 11/1993 | Theurer et al. | 104/2 |
| 5,289,648 A | * | 3/1994 | Theurer et al. | 37/104 |
| 5,394,944 A | * | 3/1995 | Theurer et al. | 171/16 |
| RE35,788 E | * | 5/1998 | Theurer et al. | 37/104 |
| 6,481,358 B2 | * | 11/2002 | Theurer et al. | 104/2 |

FOREIGN PATENT DOCUMENTS

| | | |
|---|---|---|
| DE | 240 043 | 8/1985 |
| DE | 43 43 148 | 10/1994 |
| EP | 0 629 744 | 5/1994 |
| FR | 714 645 | 7/1930 |
| FR | 1029167 | 12/1950 |

* cited by examiner

*Primary Examiner*—Thomas B. Will
*Assistant Examiner*—Nathan Mammen
(74) *Attorney, Agent, or Firm*—Collard & Roe, P.C.

(57) ABSTRACT

A ballast cleaning machine comprises a machine frame supported on the track by undercarriages for movement in an operating direction. Two vertically and laterally adjustable endless ballast excavating chains are sequentially arranged in a longitudinal direction for excavating ballast from the ballast bed, and a track lifting device mounted on the machine frame. A first conveyor arrangement conveys the ballast excavated by the first endless ballast excavating chain to a first screening installation, a second conveyor arrangement conveys the ballast excavated by the second endless ballast excavating chain to a second screening installation, and a third conveyor arrangement distributes the cleaned ballast to the ballast bed.

5 Claims, 1 Drawing Sheet

BALLAST CLEANING MACHINE

BACKGROUND OF THE INVENTION

1. Field of the Invention

The present invention relates to a ballast cleaning machine for cleaning a ballast bed supporting a track, which comprises a machine frame extending in a longitudinal direction and supported on the track by undercarriages for movement in an operating direction, two vertically and laterally adjustable endless ballast excavating chains sequentially arranged in the longitudinal direction for excavating ballast from the ballast bed, a first one of the endless ballast excavating chains leading a second one of the endless ballast excavating chains in the operating direction, and a track lifting device mounted on the machine frame. Conveyor arrangements are provided for conveying the excavated ballast to a screening installation for cleaning ballast, and for distributing the cleaned ballast to the ballast bed.

2. Description of the Prior Art

Ballast cleaning machines of this type have been disclosed in published German paent application No. 43 43 148 A1, French patent No. 1,029,167 and German Democratic Republic patent No. 240 043. These machines have a machine frame supported on undercarriages at the ends of the machine frame for movement on the track in an operating direction, and two excavating chains are mounted on the machine frame immediately following each other in the operating direction. A ballast cleaning screening installation is arranged between the two ballast excavating chains. While the machine continuously advances along the track, the first excavating chain, as seen in the operating direction, excavates the ballast and conveys it to the screening installation, and the second, trailing excavating chain removes the soil underlying the ballast bed. The removed soil is conveyed to trailing storage cars. Before the cleaned ballast is distributed from the screening installation, a protective sand layer is laid on the subgrade.

French patent No. 714,645 shows an arrangement of four endless bucket chains for raising excavated ballast and convey it to a screening installation.

Another machine for rehabilitating a ballast bed is disclosed in European patent application No. 0 629 744 B1. A first excavating chain excavates a layer of ballast, and the excavated ballast is comminuted in a stone crusher. The comminuted ballast is distributed on the excavated ballast bed and compacted to serve as a protective layer over the subgrade. A second excavating chain mounted on a second machine frame removes soil, which is replaced by the protective layer, whereupon the track is laid. In a subsequent operating stage, new ballast is introduced to provide a ballast bed.

SUMMARY OF THE INVENTION

It is the primary object of this invention to provide a ballast cleaning machine of the first-described type, which achieves a particularly high ballast cleaning efficiency with two endless ballast excavating chains which encompass the track.

The above and other objects are accomplished in accordance with the invention with a ballast cleaning machine for cleaning the ballast bed supporting a track, which comprises a machine frame extending in a longitudinal direction and supported on the track by undercarriages for movement in an operating direction. Two vertically and laterally adjustable endless ballast excavating chains are sequentially arranged in the longitudinal direction for excavating ballast from the ballast bed, a first one of the endless ballast excavating chains leading a second one of the endless ballast excavating chains in the operating direction. A track lifting device is mounted on the machine frame, a first conveyor arrangement conveys the ballast excavated by the first endless ballast excavating chain to a first screening installation for cleaning ballast, the first conveyor arrangement having an input end arranged to receive the excavated ballast from the first endless ballast excavating chain and an output end arranged to discharge the conveyed excavated ballast into the first screening installation, a second conveyor arrangement conveys the ballast excavated by the second endless ballast excavating chain to a second screening installation, the second conveyor arrangement having an input end arranged to receive the excavated ballast from the second endless ballast excavating chain and an output end arranged to discharge the conveyed excavated ballast into the second screening installation, and a third conveyor arrangement distributes the cleaned ballast to the ballast bed.

A machine combining these features substantially enhances the ballast excavating capacity in a ballast cleaning operation so that very large screening installations may be used for cleaning the large volume of excavated ballast. By providing two separate screening installations at respective ends of the machine, optimal adaptation to different capacities of the two endless ballast excavating chains may be obtained. In the case of a badly encrusted ballast bed section, for example, the ballast cleaning operation may be readily optimized by subjecting a first ballast bed section which is relatively clean to a normal cleaning on the first screening installation while the heavily encrusted or dirty ballast bed section is subjected to intensive cleaning on a specially designed second screening installation.

BRIEF DESCRIPTION OF THE DRAWING

The above and other objects, features and advantages of the invention will become more apparent from the following detailed description of now preferred embodiments, taken in conjunction with the accompanying drawing wherein.

DETAILED DESCRIPTION OF THE PREFERRED EMBODIMENTS

Figure 1:
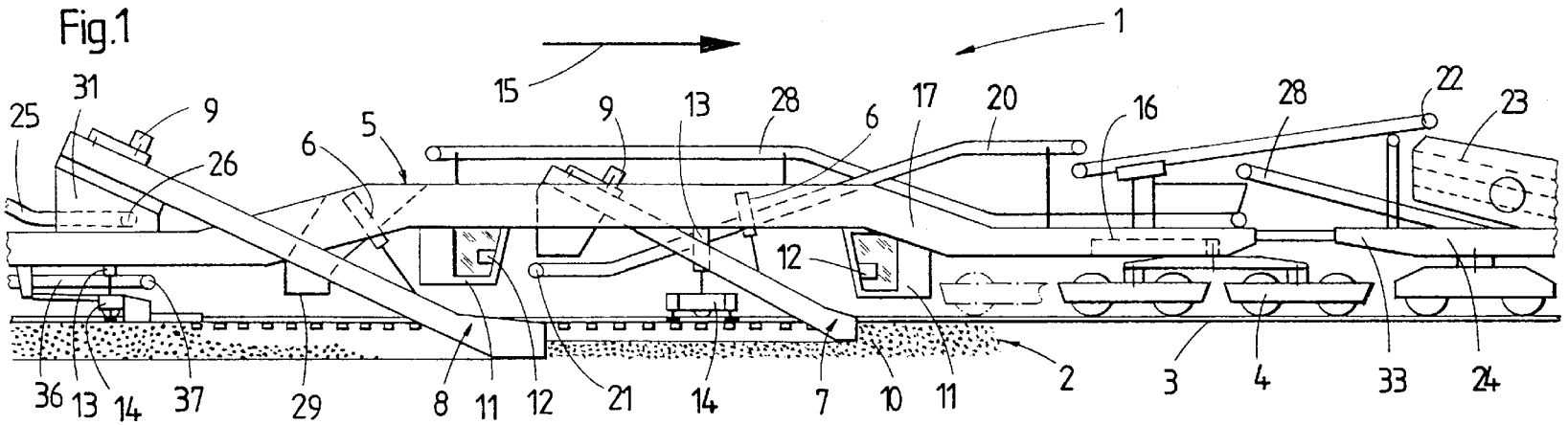
FIG. 1 illustrates a side elevational view of the front part of a ballast cleaning machine according to the present invention.
Figure 2:
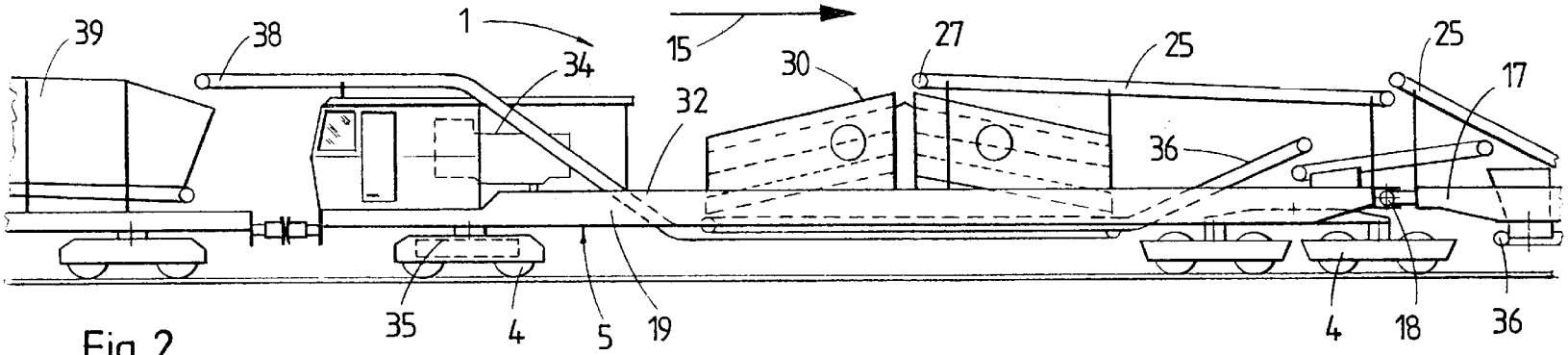
FIG. 2 is a like view of the rear part of the ballast cleaning machine.

FIGS. 1 and 2 show ballast cleaning machine 1 for cleaning ballast bed 2 supporting track 3. The ballast cleaning machine comprises machine frame 5 extending in a longitudinal direction and supported on the track by undercarriages 4 for movement in an operating direction indicated by arrow 15. One of the undercarriages 4 at a front end of the machine frame is displaceable in the longitudinal direction, being slidable in a guide 16 in machine frame 5 for displacement relative to the machine frame. Two vertically and laterally adjustable endless ballast excavating chains 7, 8 are sequentially arranged in the longitudinal direction for excavating ballast 10 from the ballast bed, first endless ballast excavating chain 7 leading second endless ballast excavating chain in the operating direction. Drives 6 vertically and laterally adjust each endless ballast excavating chain, and drives 9 revolve the same for excavating the ballast into which a transverse front strand of the chains is immersed underneath track 3.

Preferably and as illustrated, a respective operator's cab 11 is mounted on machine frame 5 in view of each endless ballast excavating chain 7, 8, and a control 12 for drives 6, 9 is arranged in each operator's cab. Two track lifting devices 14 operated by vertical adjustment drives 13 are mounted on the machine frame. As shown, one of the track lifting devices 14 is associated with first endless ballast excavating chain 7 and another one of the track lifting devices is mounted on machine frame 5 near ballast discharge 27.

In the illustrated embodiment, machine frame 5 is comprised of two machine frame parts 17, 19 linked together by articulated coupling 18, one undercarriage 4 supporting both machine frame parts on track 3 at articulated coupling 18. The two endless ballast excavating chains 7, 8 are mounted on first machine frame part 17, and the undercarriage 4 displaceable in the longitudinal direction supports an end of the first machine frame part 17.

A first screening installation 23 for cleaning ballast 10 is mounted on a car 24 linked to machine frame 5 at a front end thereof, and a first conveyor arrangement 20 for conveying the ballast excavated by the first endless ballast excavating chains 7 to first screening installation 23 extends from input end 21 below a discharge end of endless ballast excavating chain 7 and receiving excavated ballast therefrom to output end 22 discharging the excavated ballast into screening installation 23. A second conveyor arrangement 25 extends from input end 26 below a discharge end 31 of second endless ballast excavating chain 8 and receiving excavated ballast therefrom to output end 27 discharging the excavated ballast into a second screening installation 30. First screening installation 23 leads first endless ballast excavating chain 7 in the operating direction while second screening installation 30 is arranged rearwardly of second endless ballast excavating chain 8 in the operating direction.

A third conveyor arrangement 28, which distributes the ballast cleaned in first screening installation 23 to ballast bed 2, extends in the longitudinal direction above first endless ballast excavating chain 7, passes through a central spaced defined by second endless ballast excavating chain 8 trailing the first endless ballast excavating chain in the operating direction, and ends in a ballast discharge chute 29 positioned between machine frame 5 and track 6. A fourth conveyor arrangement 36, which distributes the ballast cleaned in second screening installation 30 to the ballast bed, ends in a ballast discharge end 37 adjacent ballast discharge chute 29.

Second screening installation 30 is mounted on second machine frame part 19 between the two undercarriages 4 supporting the ends of the second machine frame part. In the illustrated embodiment, this screening installation comprises a pair of screens designed for intensive cleaning of the heavily encrusted ballast. A further conveyor arrangement 38 serves to remove detritus to a storage car 39 coupled to the rear end of the machine. If desired, such a storage car may be coupled to the front end of the machine.

A power source 34 is carried by the second machine frame part for supplying power to motor 35 for moving machine 1 along the track, as well as to all the operating drives on the machine.

Ballast cleaning machine 1 is operated in the following manner:

Immediately before the ballast cleaning operation is started, foremost undercarriage 4 supporting machine frame 5 on track 3 is displaced from its retracted transit position indicated in phantom lines in FIG. 1 to the operating position shown in full lines. This enlarges the excavating section defined between the foremost undercarriage and the next following undercarriage wherebetween endless ballast excavating chains 7, 8 are mounted on the machine frame. This facilitates lifting of the track section between the two undercarriages under which the supporting ballast bed is excavated.

As ballast cleaning machine 1 continuously advances along the track, an upper layer of ballast bed 2 is excavated by first endless ballast excavating chain 7 in a first operating stage. Excavated ballast 10 is conveyed by first conveyor arrangement 20 from input end 21 to output end 22 for discharge into first screening installation 23. As required by operating conditions, an operator in operator's cab 11 within view of endless ballast excavating chain 7 may operate control 12 for actuating drives 6 and 9.

While track 3 remains raised by track lifting device 14, a second layer of ballast is excavated by second endless ballast excavating chain 8 immediately behind the first endless ballast excavating chain, and the excavated ballast is conveyed by conveyor arrangement 25 from input end 26 to output end 27 for discharge into second screening installation 30. As required by operating conditions, an operator in operator's 11 within view of endless ballast excavating chain 8 may operate control 12 for actuating drives 6 and 9 of the second endless ballast excavating chain.

The ballast excavated by first and second endless ballast excavating chains 7, 8 and cleaned in first and second screening installations 23, 30 is conveyed by third and fourth conveyor arrangements 28, 36 to be distributed over the ballast bed at discharge points 29, 37. Track 3 is then lowered onto the restored ballast bed for support thereon.

What is claimed is:

1. A ballast cleaning machine for cleaning a ballast bed supporting a track, which comprises (a) a machine frame extending in a longitudinal direction and supported on the track by undercarriages for movement in an operating direction, (b) two vertically and laterally adjustable endless ballast excavating chains sequentially arranged in the longitudinal direction for excavating ballast from the ballast bed, a first one of the endless ballast excavating chains leading a second one of the endless ballast excavating chains in the operating direction, (c) a track lifting device mounted on the machine frame, (d) a first screening installation for cleaning ballast, (e) a second screening installation for cleaning ballast, (f) a first conveyor arrangement for conveying the ballast excavated by the first endless ballast excavating chain to the first screening installation, the first conveyor arrangement having an input end arranged to receive the excavated ballast from the first endless ballast excavating chain and an output end arranged to discharge the conveyed excavated ballast into the first screening installation, (g) a second conveyor arrangement for conveying the ballast excavated by the second endless ballast excavating chain to the second screening installation, the second conveyor arrangement having an input end arranged to receive the excavated ballast from the second endless ballast excavating chain and an output end arranged to discharge the conveyed excavated ballast into the second screening installation, and (h) a third conveyor arrangement for distributing the cleaned ballast to the ballast bed.

2. The ballast cleaning machine of claim 1, wherein the first screening installation leads the first endless ballast excavating chain in the operating direction while the second screening installation is arranged rearwardly of the second endless ballast excavating chain in the operating direction.

3. The ballast cleaning machine of claim 1, further comprising drives for revolving and for vertically and laterally adjusting each one of the endless ballast excavating chains, a respective operator's cab arranged on the machine frame within view of each endless ballast excavating chain, and a control for the drives arranged in each operator's cab.

4. The ballast cleaning machine of claim 1, wherein one of the undercarriages at an end of the machine frame is displaceable in the longitudinal direction relative to the machine frame.

5. The ballast cleaning machine of claim 1, wherein the machine frame is comprised of two machine frame parts linked together by an articulated coupling, one of the undercarriages supporting both machine frame parts on the track at the articulated coupling, the two endless ballast excavating chains being mounted on the first machine frame part, the displaceable undercarriage supporting an end of the first machine frame part, and the second machine frame part being supported by two undercarriages at their ends.

* * * * *